United States Patent [19]

Jones

[11] 3,997,102

[45] Dec. 14, 1976

[54] PARTITION MEMBER

[76] Inventor: Robert James Jones, 9670-13th Ave., S., Minneapolis, Minn. 55420

[22] Filed: Nov. 24, 1975

[21] Appl. No.: 634,604

[52] U.S. Cl. ..... 229/15; 229/42

[51] Int. Cl.[2] ..... B65D 5/48; B65D 85/00

[58] Field of Search ..... 229/15, 42, 28 BC; 217/23, 33

[56] References Cited

UNITED STATES PATENTS

| | | | |
|---|---|---|---|
| 3,253,763 | 5/1966 | Henderson | 229/15 |
| 3,626,494 | 12/1971 | Levin | 229/15 |
| 3,702,170 | 11/1972 | Adams | 229/15 |
| 3,756,496 | 9/1973 | Oostdik | 229/15 |
| 3,758,018 | 9/1973 | Black | 229/15 |
| 3,871,569 | 3/1975 | Wharton, Jr. | 229/15 |
| 3,921,891 | 11/1975 | Gorham | 229/15 |
| 3,931,924 | 1/1976 | Gardner et al. | 229/28 R |

*Primary Examiner*—Davis T. Moorhead

[57] ABSTRACT

A partition is provided for dividing a container into a series of compartments. The partition shown divides the container into six equal sized compartments and is formed of one sheet of paperboard folded to form the compartments.

10 Claims, 11 Drawing Figures

PARTITION MEMBER

This invention relates to an improvement in partition member, and deals particularly with a partition member which is preferably formed in one piece, and which in its preferred form divides the interior of a container into six compartments which are normally of similar size.

BACKGROUND OF THE INVENTION

Perhaps the most common partition member is formed of intersecting panels which are slotted with certain of the slots opening upwardly and other of the slots opening downwardly so that they may be fitted together to form the desired compartments. While partitions of this type serve to provide the dividing walls between containers so as to protect the containers from breakage, they must normally be hand assembled in the absence of a rather complicated apparatus to assemble them. Furthermore, the walls between the various compartments are usually quite flexible in view of the fact that each of the intersecting members is slotted throughout one-half its height to interfit with the intersecting members. A feature of the present invention lies in eliminating the difficulties previously experienced with partitions of the normal type and to provide a stronger and sturdier partition.

SUMMARY OF THE INVENTION

The present invention resides in the provision of a partition which is normally formed of three panels of equal size, one panel forming the partition wall which normally extends longitudinally of the container, and the remaining panels including parallel fold lines so that the ends of the panels may be folded into right angular relation to the longitudinal panel. These additional panels are provided with tongues which extend into apertures in the longitudinal panel, and are arranged so that when the end portions of the additional panels are folded into right angular relation to the first panel, they lock into place so that the partition maintains its shape, and the bottles or other containers used may be inserted into the outer paperboard container either manually or automatically by machine.

A feature of the present invention resides in the fact that the partition may be formed by merely folding the ends of the outer panels into right angular relation to the intermediate or central panel and automatically lock into place so that when the partition is inserted into an outer paperboard container, or other outer container, the various panels of the partition remain in place at substantially right angles to the longitudinal partition member so that the bottles or other containers which are used may be inserted into the outer container without difficulty.

In preferred form, the partition is formed of three generally rectangular panels of substantially equal size, the first panel forming the longitudinally extending partition member, and the other two panels are folded to enclose the first panel. The three panels are preferably secured together with the central portions in face contact either by adhesive or by suitable locking means. The three panels, being of substantially the same size in being folded into face contact, are easily stored and shipped in this flat condition. When the partition is to be used, it is only necessary to fold the ends of the outer panel outwardly into substantially right angular relation to the central panel, and the end portions of the outer two panels form transverse partition members extending in opposed relations. Locking means operate automatically to hold the transverse partition members in substantially right angular relation to the first panel, so that compartments of substantially equal size are automatically formed.

A feature of the present invention resides in the provision of a partition of the type described in which the center or middle panel is provided with apertures extending therethrough, and in which each of the outer panels is provided with tongues which may extend through the apertures in the center panel and to registering apertures in the outer panels which lock against a wall of the aperture and hold the outer end portions of the outer panels in right angular relation to the middle panel. This construction forms a partition having six compartments of substantially equal size although obviously the outer compartments may be of somewhat different size from the intermediate compartments. With this arrangement, when the partition is inserted into an outer container, the compartments maintain their general form so that the containers which fit into the various compartments may be filled in automatical filling machines when so desired.

These and other objects and novel features of the present invention will be more clearly and fully set forth in the following specification and claims.

In the drawings forming a part of the specification.

FIG. 1 is a perspective view of the partition in readiness for insertion into an outer paperboard container or the like.

Figure 5:
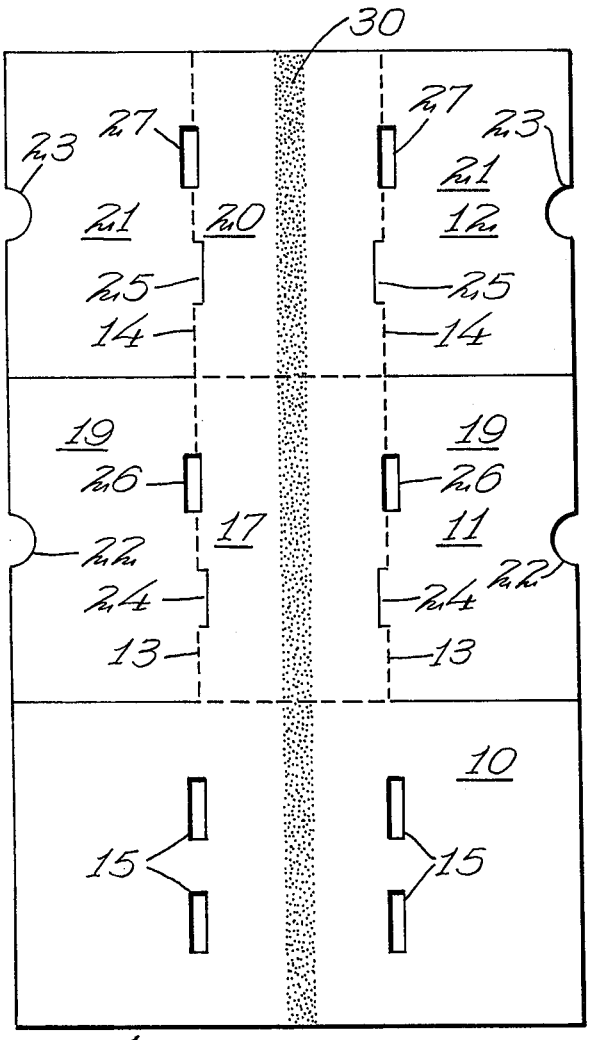
FIG. 5 is a diagrammatic view of the blank from which the partition is formed.

Referring now to FIG. 5 of the drawings, the partition A includes a middle panel 10, a first outside panel 11, and a second outside panel 12. The panel 11 is divided into three substantially equal areas by parallel fold lines 13, and the second outside panel 12 is also divided into three substantially equal sections by fold lines 14 which are aligned with the fold lines 13. When folded, the fold lines 13 and 14 are in contiguous relation.

Figure 6:
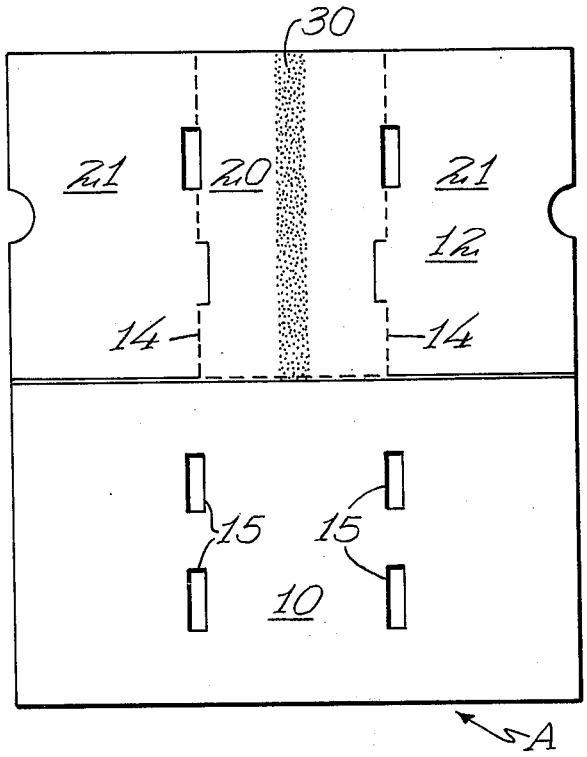
FIG. 6 is a view similar to FIG. 5, but showing the middle panel folded to overlie one of the outside panels.
Figure 7:
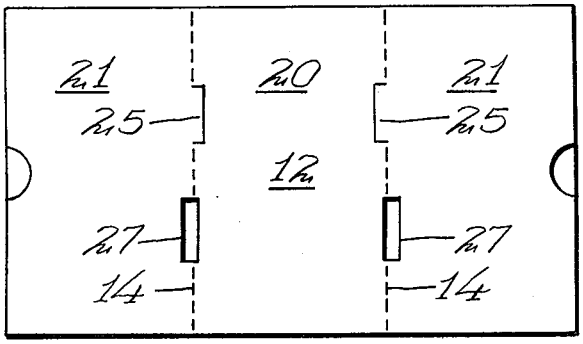
FIG. 7 is a view similar to FIG. 6 but in which the other outside panel is folded to overlie the central panel.
Figure 8:
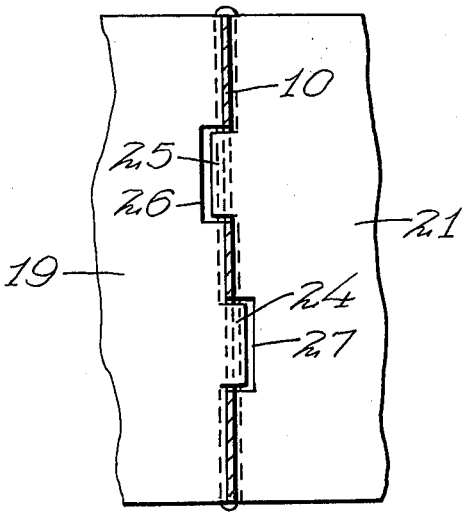
FIG. 8 is a vertical section view extending transversely of the partition member adjacent to one of the pairs of transverse partitions, the position of the section being indicated by the line 8—8 of FIG. 1.

FIG. 6 shows the middle panel 10 folded to over lie one of the outside panels 11. FIG. 7 shows the partition after it has been completely formed for use.

As is indicated in FIGS. 5 and 6 of the drawings, the panel 10 is provided with four elongated apertures 15, two of which are in alignment with the inner edges in alignment with the fold lines 13 and 14. The fold lines 13 and 14 divide the panel 11 into a central portion 17 and a pair of outer portions 19 all of which are of equal width.

In the same manner, the fold lines 14 provide the panel 12 into three sections of equal width including a center section 20 and a pair of outer sections 21. Finger notches 22 are provided in the panel 11, and similar finger notches 23 are provided in the outer edges of the panel 12. These finger notches 22 and 23 expose an area of the central panel and simplify the operation of folding the end portions 19 and 21 of the panels 11 and 12 into right angular relation to the middle panel 10.

Figure 1:
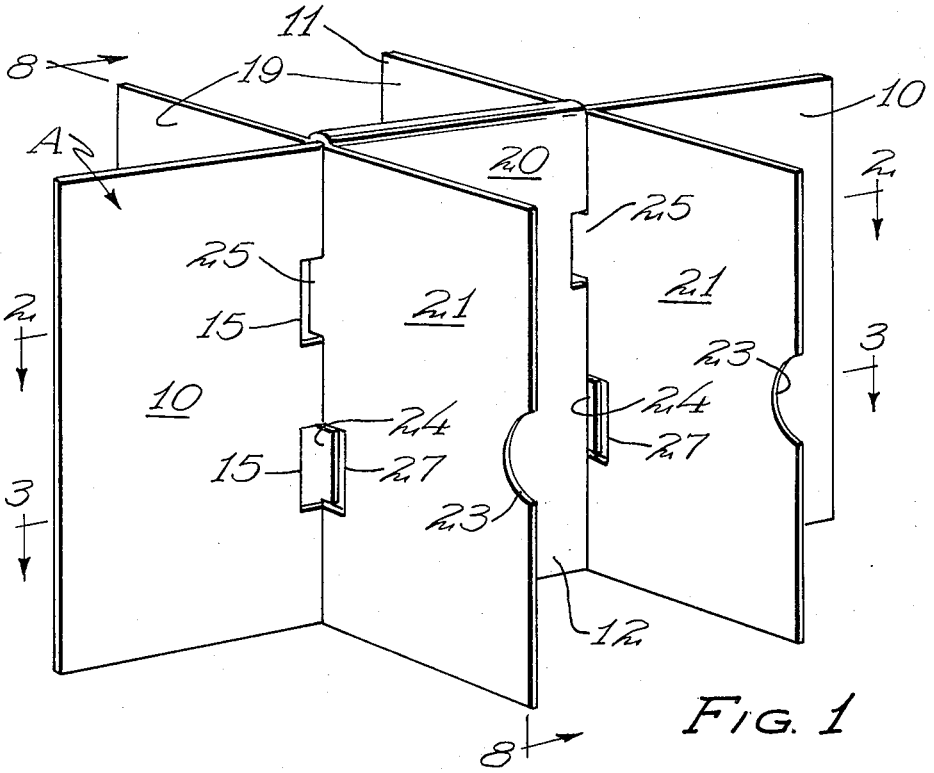
Figure 2:
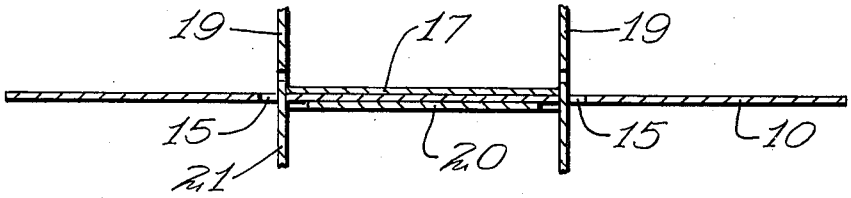
FIG. 2 is a horizontal sectional view through the partition, the position of the section being indicated by the line 2—2 of FIG. 1.
Figure 3:
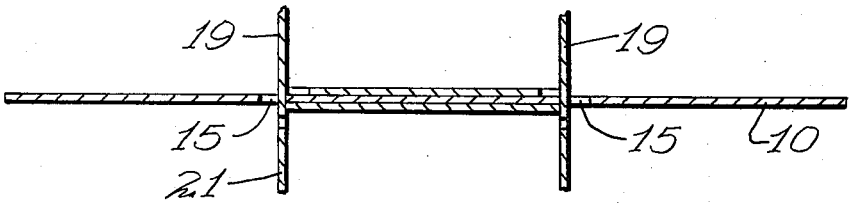
FIG. 3 is a view similar to FIG. 2, the position of the section being indicated by the line 3—3 of FIG. 1.
Figure 4:
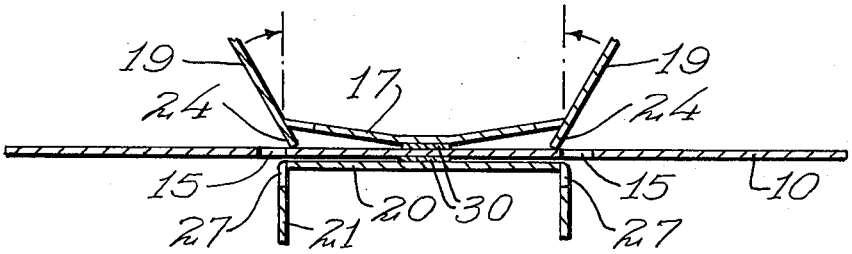
FIG. 4 is a diagrammatic view indicating the manner in which the transverse partitions are folded into right angular relation to the central partition member.
Figure 10:
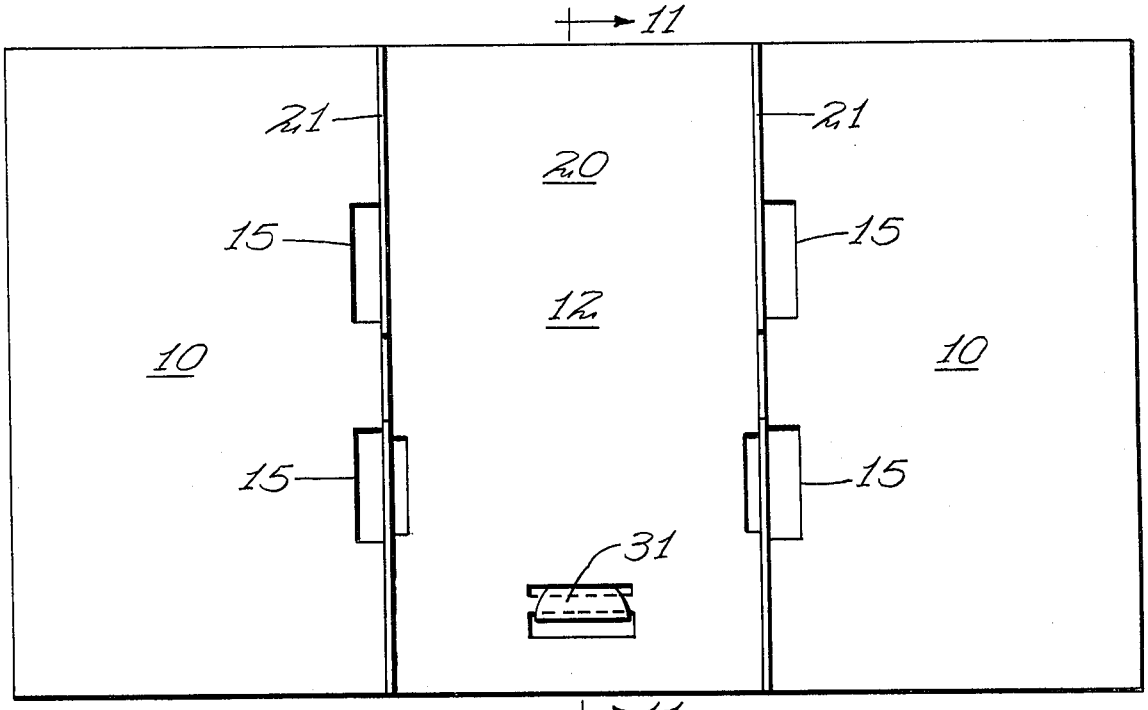
FIG. 10 is an elevation view of the partition member shown in FIG. 9 after the panels have been locked together.
Figure 9:
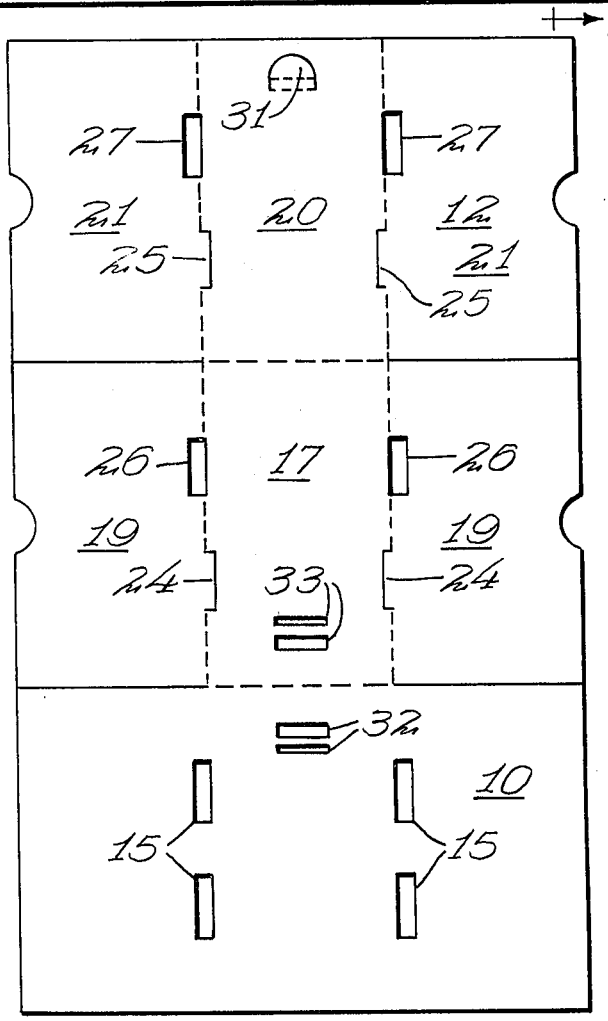
FIG. 9 is a diagrammatic view of the blank showing a slightly different means of locking the panels together.
Figure 11:
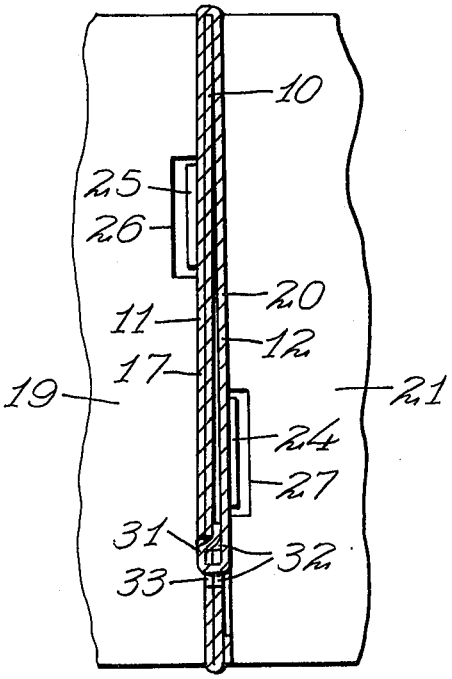
FIG. 11 is a sectional view through the partition member shown in FIG. 10, the position of the section being indicated by the line 11—11 of FIG. 10.

Tongues 24 are defined by U-shaped cut lines terminating at the fold line 13, and extending into the central portion 17 of the panel 11. Similar tongues 25 interrupt the fold line 14 and are defined by U-shaped cut lines extending into the central portion 20 of the panel 12. The panel 11 is provided with apertures 26 which are folded into registry with two of the apertures 15 and the middle panel 10 and similar apertures 27 are provided adjacent to fold line 14 in the other outer panel 12 which fold into alignment with the other pair of apertures 15 in the panel 10. Means is provided for holding the central portions of the panels in face contact. In FIGS. 4 to 6 of the drawings, this means comprises a strip of adhesive 30 extending throughout the length of the blank midway between the fold lines 13 and 14. The structure shown in FIGS. 9, 10 and 11 of the drawings is identical to that previously described except for the fact that it includes a locking tongue 31 in the panel 12 which extends through registering spaced parallel slots 32 in the panel 10 and 33 in the panel 11.

FIG. 4 diagrammatically illustrates the manner in which the central portions 17 and 20 of the outer partition panels flex during the operation of folding the end portions 19 and 21 into right angular relation to the center panel 10. Obviously, when the tongues such as 24 swing into registry with the apertures 15, the tongues extend through the apertures and lock the panels 19 into right angular relationship with the central panel 10.

In accordance with the Patent Statutes, I have described the principles of construction and operation of my Partition Member, and while I have endeavored to set forth the best embodiments, I desire to have it understood that obvious changes may be made within the scope of the following claims without departing from the spirit of my invention.

I claim:

1. A partition including a series of three generally rectangular panels of substantially equal sizes with one full length panel between the second and third panels, parallel fold lines extending across the second and third panels dividing each of these panels into three sections of substantially equal size, the fold lines in the first and third panels being contiguous, a pair of spaced apertures in said first panel in the area outwardly of each of said fold lines in said second and third panels, and tabs on said outer sections of said second and third panels formed by generally V-shaped cut lines in the intermediate section of said second and third panels and terminating adjoining said fold lines within the length of said apertures, said tabs engaging against an edge of a corresponding aperture when said outer sections of said second and third panels are folded into right angles to said first panel, the second and third panels including apertures into which said tabs may extend where the tabs on the opposite panel are folded through said apertures in said first panel.

2. A partition member including the structure of claim 1 and in which the second and third panels are secured in face contact only in the sections between said fold lines and spaced substantially from the fold line, whereby said sections may flex apart adjoining said fold lines as said tabs are folded through said apertures.

3. The structure of claim 1 and in which said apertures in said first panel are elongated and parallel to said fold lines.

4. The structure of claim 2 and in which said panels are connected by a strip of glue between, and parallel to said fold lines.

5. The structure of claim 2 and in which said panels are connected between said fold lines by locking means.

6. The structure of claim 1 and in which said panels are foldably connected along the edges of said sections between said fold lines.

7. The structure of claim 1 and including locking tongues on said second and third panels formed by generally V-shaped cut lines extending into the central sections thereof from said fold lines, said tongues being located adjacent to said apertures in said first panel when said panels are parallel, and extending through said apertures when said end sections are folded into angular relation to the center sections to which they are connected.

8. The structure of claim 7 and in which said outer sections of said second and third panels are provided with at least one aperture adjoining each of said fold lines and registrable with one of said apertures in said first panel, and adjoining one of said tongues in the other said second and third panels, whereby when said end sections are folded into right angular relation to the center section thereof, a tongue on each end section of said second and third panels will extend through one of said apertures in said first panel and through one of said apertures in other end section of the opposed second and third panel to engage an edge of said one aperture to fold the attached end section in angular relation to said center section of the end section.

9. A partition member including three generally rectangular panels including a first central panel and a pair of second and third panels on opposite sides of said first central panel, means securing said center portions of said panels in parallel contacting relation, said second and third panels being divided by parallel fold lines into three sections, each fold line in the second panel being contiguous with a fold line in the third panel, said fold lines dividing said second and third panels into a central section and a pair of outer sections, and cooperable locking means adjoining the fold lines operable to automatically hold said outer sections in angular relation to said central panel when folded into said angular relation.

10. The structure of claim 9 and in which said center portion of said first central panel is hingedly connected to the center portions of said second and third panels.

* * * * *